US005403486A

United States Patent [19]

Leung

[11] Patent Number: 5,403,486

[45] Date of Patent: Apr. 4, 1995

[54] ACCELERATOR SYSTEM IN A CENTRIFUGE

[75] Inventor: Woon F. Leung, Norfolk, Mass.

[73] Assignee: Baker Hughes Incorporated, Houston, Tex.

[21] Appl. No.: 816,599

[22] Filed: Dec. 31, 1991

[51] Int. Cl.[6] ..... B04B 1/20

[52] U.S. Cl. ..... 210/512.1; 210/380.1; 494/53; 494/54

[58] Field of Search ..... 210/360.1, 380.1, 512.1, 210/512.3; 494/52, 53, 54, 55, 85

[56] References Cited

U.S. PATENT DOCUMENTS

| | | | |
|---|---|---|---|
| 1,336,722 | 4/1920 | Behr . | |
| 1,363,699 | 12/1920 | Ward . | |
| 1,536,988 | 5/1925 | Thomassen . | |
| 1,733,266 | 10/1929 | Jones . | |
| 2,199,849 | 5/1940 | Bryson . | |
| 2,236,769 | 4/1941 | Armbruster . | |
| 2,243,697 | 5/1941 | Forsberg . | |
| 2,462,098 | 2/1949 | Hertrich . | |
| 2,593,294 | 4/1952 | Goldberg . | |
| 2,670,131 | 2/1954 | Ried . | |
| 2,733,856 | 2/1956 | Kjellgren . | |
| 2,856,072 | 10/1958 | Konstad . | |
| 3,228,592 | 1/1966 | Shapiro . | |
| 3,368,747 | 2/1968 | Lavanchy et al. . | |
| 3,428,246 | 2/1969 | Finkelston . | |
| 3,616,992 | 11/1971 | Deacon . | |
| 3,620,442 | 11/1971 | Halloran, Jr. . | |
| 3,795,361 | 3/1974 | Lee . | |
| 3,795,362 | 3/1974 | Caldwell et al. . | |
| 3,885,734 | 5/1975 | Lee . | |
| 3,934,792 | 1/1976 | High et al. . | |
| 3,963,175 | 6/1976 | Daubman et al. . | |
| 4,037,781 | 7/1977 | High . | |
| 4,142,669 | 3/1979 | Burlet | 494/53 |
| 4,173,303 | 11/1979 | Cyphelly . | |
| 4,190,194 | 2/1980 | Amero . | |
| 4,245,777 | 1/1981 | Lavanchy . | |
| 4,298,160 | 11/1981 | Jackson . | |
| 4,334,647 | 6/1982 | Taylor | 494/53 |
| 4,339,072 | 7/1982 | Hiller . | |
| 4,449,967 | 5/1984 | Caldwell . | |
| 4,451,247 | 5/1984 | Ostkamp et al. . | |
| 4,496,340 | 1/1985 | Redeker et al. . | |
| 4,634,536 | 1/1987 | Grimwood et al. . | |
| 4,714,456 | 12/1987 | Bender et al. | 494/53 |
| 4,731,182 | 3/1988 | High . | |
| 4,761,157 | 8/1988 | Shapiro . | |
| 4,957,475 | 9/1990 | Kreill | 494/53 |

FOREIGN PATENT DOCUMENTS

| | | |
|---|---|---|
| 758458 | 5/1967 | Canada . |
| 3723864 | 1/1989 | Germany . |

*Primary Examiner*—Robert A. Dawson
*Assistant Examiner*—David Reifsnyder

[57] ABSTRACT

A liquid accelerator system for use in a centrifuge, the system comprising a conveyor hub rotatably mounted within a rotating bowl, the hub including an inside surface and an outside surface. At least one feed slurry or wash liquid passageway is disposed between the inside surface of conveyor hub and the outside surface of the conveyor hub. A plurality of outwardly extending extensions is associated with each passageway. In the preferred embodiment, the extensions having an axis oriented parallel to and at forward angles to the radial direction of the conveyor hub at the passageway are U-shaped channels. The extensions having an axis oriented at reverse angles to the radial direction of the convey hub at the passageway are full channels. A plurality of partitions extends in a circumferential direction from the discharge end of each U-shaped channel and each full channel so as to form a plurality of discharge channels. A flow directing and overspeeding vane is disposed within each discharge channel and extends radially and circumferentially from each discharge end. Each flow directing and overspeeding vane includes a different forward discharge angle and is angled in the direction of rotation of the conveyor hub.

26 Claims, 8 Drawing Sheets

FIG. 6A
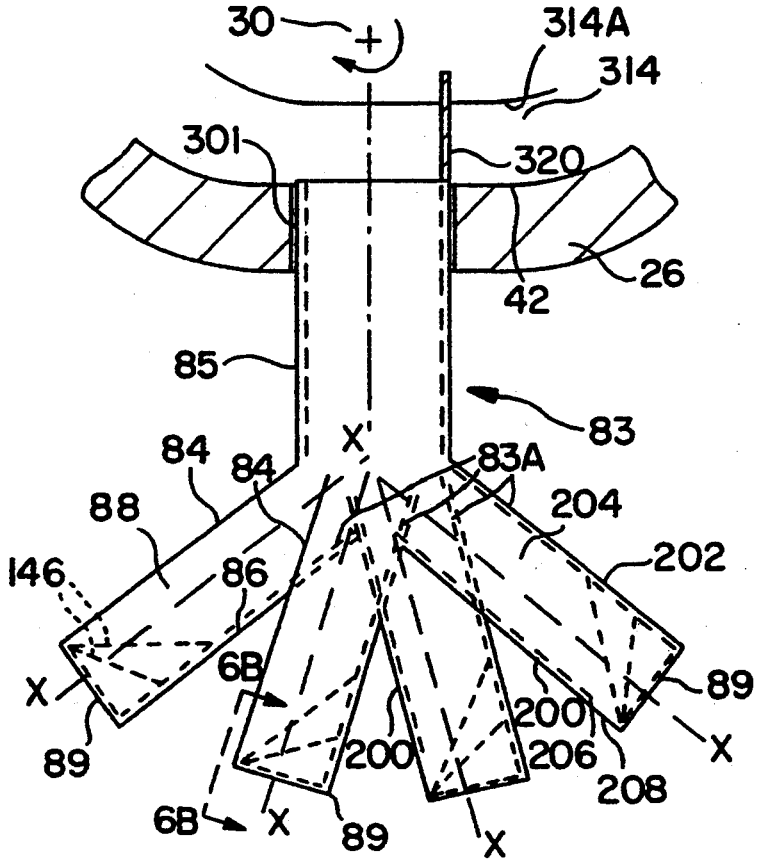
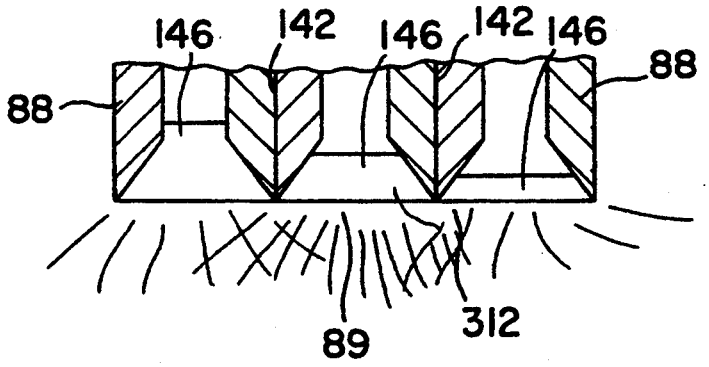
FIG. 6B

ACCELERATOR SYSTEM IN A CENTRIFUGE

BACKGROUND OF THE INVENTION

Conventional sedimentation or filtration systems operating under natural gravity have a limited capacity for separating a fluid/particle or fluid/fluid mixture, otherwise known as a feed slurry, having density differences between the distinct phases of the slurry. Therefore, industrial centrifuges that produce large centrifugal acceleration forces, otherwise known as G-levels, have advantages and thus are commonly used to accomplish separation of the light and heavy phases. Various designs of industrial centrifuges include, for example, the decanter, screenbowl, basket, and disc centrifuge.

Industrial centrifuges rotate at very high speeds in order to produce large centrifugal acceleration forces. Several problems arise when the feed slurry is introduced into the separation pool of the centrifuge with a linear circumferential speed less than that of the centrifuge bowl.

First, the centrifugal acceleration for separation is not fully realized. The G-level might be only a fraction of what is possible. The G-level is proportional to the square of the effective acceleration efficiency. The latter is defined as the ratio of the actual linear circumferential speed of the feed slurry entering the separation pool to the linear circumferential speed of the rotating surface of the separation pool. For example, if the acceleration efficiency is 50 percent, the G-level is only 25 percent of what might be attained and the rate of separation is correspondingly reduced.

Second, the difference in circumferential linear speed, between the slurry entering the separation pool and the slurry within the separation pool which has been fully accelerated by the rotating conveyor and bowl, leads to undesirable slippage, otherwise known as velocity difference, and this creates turbulence in the slurry lying within the separation pool. Such turbulence results in resuspension of the heavy phase, equivalent to a remixing of the heavy phase material and the lighter phase material.

Third, because a portion of the separation pool is used to accelerate the feed slurry, the useful volume of the separation pool is reduced, and thus the separation efficiency of the centrifuge is lessened.

Fourth, the feed slurry often exits the feed accelerator and enters the separation pool of the centrifuge in a non-uniform flow pattern, such as in concentrated streams or jets, which causes remixing of the light and heavy phases within the separation pool.

These problems are common in decanter centrifuges generally including a rotating screw-type conveyor mounted substantially concentrically within a rotating bowl. The conveyor usually includes a helical blade disposed on the outside surface of a conveyor hub, and a feed distributor and accelerator positioned within the conveyor hub. A feed slurry is introduced into the conveyor hub by a feed pipe, engages the feed distributor and accelerator, and then exits the conveyor hub through at least one passageway between the inside and outside surfaces of the conveyor hub. Normally the feed slurry exits through the passageway at a circumferential speed considerably less than that of the separation pool surface, thus creating the aforementioned problems. Therefore, it is desirable to incorporate feed slurry accelerator enhancements into the passageway so that the acceleration and separation efficiency of the centrifuge may be increased.

It is often desirous to wash the compacted cake solids that form on the inside surface of the bowl with a wash liquid for the purpose of either removing impurities or recovering a valuable mother liquor that may remain within the compacted cake solids. In a screenbowl centrifuge, washing of the compacted cake solids is performed on a screen section of a wash feed compartment section integral with the conveyor hub as the cake solids are conveyed along the screen section by the conveyor screw. A wash liquid is generally introduced into the wash feed compartment by at least one wash pipe. A plurality of wash nozzles extending radially from the wash compartment and proximate to the cake delivers the wash liquid to the cake. In a pusher-type centrifuge, washing of the compacted cake solids is performed on the basket of the centrifuge as the cake solids are conveyed along the basket by the pushing mechanism. A wash liquid is generally introduced into the pusher-type centrifuge by a pump, wash pipe and a plurality of nozzles. The wash liquid is disposed onto the cake surface in the form of a pressurized liquid stream.

When a wash liquid nozzle is positioned too close to the cake surface, the opening of the nozzle often becomes plugged with solids. In addition, the wash liquid channels through the cake resulting in only a small portion of the cake solids being washed.

To avoid such problems, the wash nozzle is positioned at a distance farther from the surface of the cake. In the case of a screenbowl centrifuge, the wash liquid is introduced onto the cake from the rotating wash feed compartment via nozzles at a smaller radius and will not achieve approximately the same circumferential velocity of the cake which is located at a larger radius. Several problems result when the wash liquid is not accelerated to the circumferential velocity of the cake. For example, the underaccelerated wash liquid slips relative to the rotating cake surface. Moreover, the wash liquid does not have the adequate centrifugal force to penetrate the cake, and thus, runs off the surface of the cake resulting in a poor and an uneven wash of the cake solids.

When a wash nozzle used in a pusher-type centrifuge is positioned at a distance from the surface of the cake, the pressurized wash liquid is brought to the circumferential velocity of the cake solids by adjusting the flow rate of the wash liquid for a given nozzle size. Consequently, other wash rates can not be easily accommodated without changing the wash nozzle dimensions. In this case, it is preferrable to introduce the wash liquid by means of a rotating wash feed compartment section including at least one multispray nozzle as more fully described below.

To achieve a desirable wash of the cake solids and a reliable washing operation, the wash liquid must be adequately and uniformly distributed onto the surface of the cake, the linear circumferential velocity of the wash liquid must be approximately equal to the circumferential velocity of the cake on the screen section of a decanter centrifuge or the basket of a pusher-type centrifuge, and the wash liquid nozzle or nozzles must be at a radial distance from the cake surface to prevent the openings of the nozzles from plugging.

SUMMARY OF THE INVENTION

The liquid accelerator system of the invention may be used to accelerate a feed slurry introduced into a centrifuge. Such a system comprises a conveyor hub rotatably mounted substantially concentrically within a rotating bowl, the hub including an inside surface and an outside surface. At least one feed slurry passageway is disposed between the inside surface of conveyor hub and the outside surface of the conveyor hub. A plurality of outwardly extending extensions forming the multispray nozzle of the invention is associated with each passageway. Each extension may be attached to the passageway, or alternatively, at least one extension may communicate and extend from a central extension attached to the passageway.

In the preferred embodiment of the multispray nozzle of the invention, at least one extension having its axis parallel to and at a forward angle to the radial direction of the conveyor hub at the passageway is a generally U-shaped channel which may include, for example, an outwardly extending base disposed between two outwardly extending side walls. A forward angle is defined by (i) a radial line originating from the axis of rotation of the centrifuge and contained within a plane perpendicular to the axis of rotation and (ii) a second line contained within the same plane and intersecting the radial line whereby the angle formed between these two lines is in the direction of rotation as measured from the radial line to the second line. At least one extension having its axis at a reverse angle to the radial direction of the conveyor hub at the passageway is a generally full channel, except perhaps for those extensions having a relatively small reverse angle or small length. A reverse angle is defined by (i) a radial line originating from the axis of rotation of the centrifuge and contained within a plane perpendicular to the axis of rotation and (ii) a second line contained within the same plane and intersecting the radial line whereby the angle formed between these two lines is opposite to the direction of rotation as measured from the radial line to the second line. The full channel may include an outwardly extending base and an outwardly extending front section disposed between two outwardly extending side walls, wherein the base extends from the passageway to a greater radial distance than the front section so that an opening is formed at the discharge end of the full channel. Both the U-shaped channel and the full channel may also include a circular or oval cross section.

A plurality of partitions extends in a circumferential direction from the discharge end of each U-shaped channel and full channel so as to form a plurality of discharge channels. A flow directing and overspeeding vane is disposed within each discharge channel and extends radially and circumferentially from the discharge end of each U-shaped channel and full channel. Each flow directing and overspeeding vane is curved or angled in the direction of rotation of the conveyor hub and includes a different forward discharge angle at its outward end. A forward discharge angle is defined by (i) a line extending tangentially from the surface of the flow directing and overspeeding vane at its discharge end and (ii) a radial line originating from the axis of rotation of the centrifuge and contained within a plane perpendicular to the axis of rotation and intersecting the tangential line at the discharge end of the flow directing and overspeeding vane, whereby the angle formed between these two lines is in the direction of rotation as measured from the radial line to the first line. Thus, the flow directing and overspeeding vanes in combination with the forward angle U-shaped channels and the reverse angle full channels cause the feed slurry to exit the multispray nozzle at different locations about the circumference of the conveyor hub, thus providing a more circumferentially uniform flow of feed slurry into the separation pool. Moreover, the flow directing and overspeeding vanes also allow for overspeeding of the feed slurry at a smaller discharge radius so that the feed slurry achieves approximately the circumferential velocity of the screen section or basket which is located at a larger radius.

The liquid accelerator system of the invention may also be used in a screenbowl or pusher-type centrifuge for accelerating a wash liquid used to wash the cake solids. In the case of a screenbowl centrifuge, at least one wash liquid passageway is disposed between the inside and outside surfaces of the conveyor hub. A multispray nozzle, as previously described, is associated with such a wash liquid passageway for spraying the cake solids with a wash liquid during the washing process. In the case of a pusher-type centrifuge, the apparatus for introducing the wash stream into the centrifuge is fitted with the multispray nozzles extending outwardly from a rotating wash feed compartment.

BRIEF DESCRIPTION OF THE DRAWINGS

FIG. 6A is a cross-sectional view of the wash feed compartment section of a screenbowl centrifuge of FIG. 5 including the multispray nozzle of the invention; and FIG. 6B is a partial cross-sectional view along line 6B—6B of FIG. 6A.

DESCRIPTION OF THE PREFERRED EMBODIMENT

Figure 1:
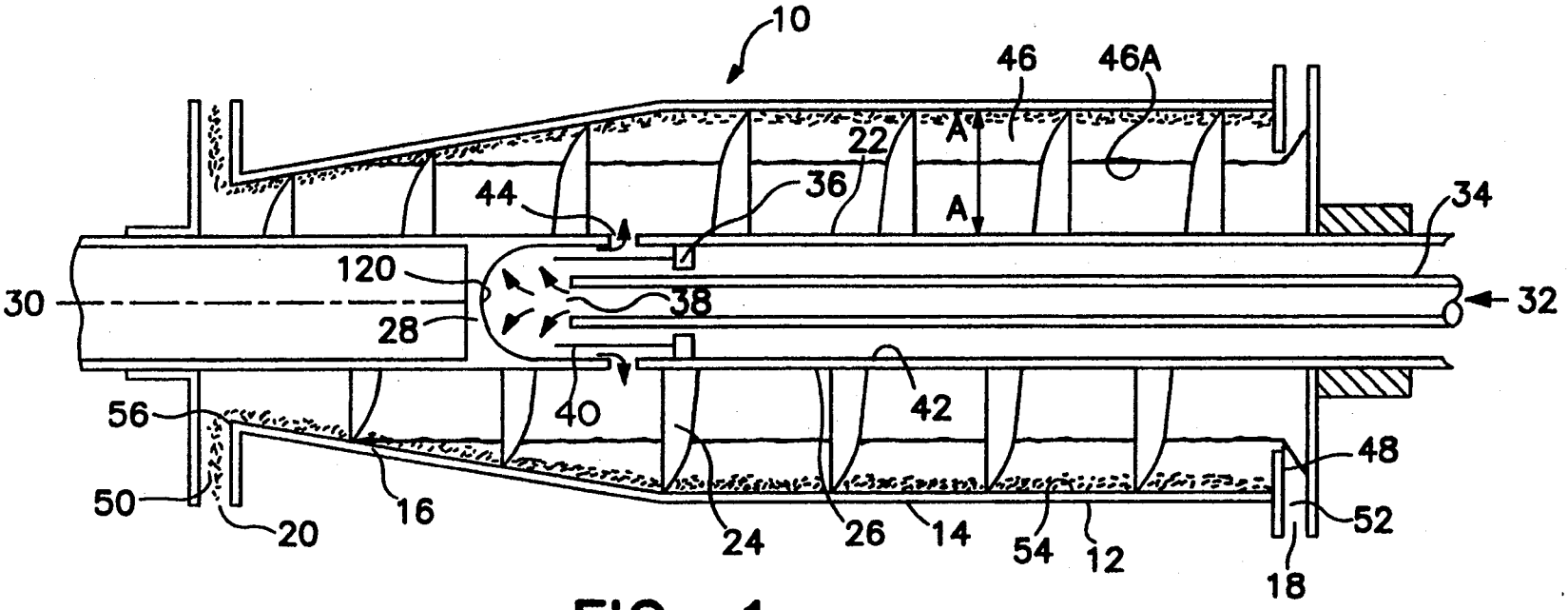
FIG. 1 is a schematic cross-sectional view of a decanter centrifuge.

FIG. 1 shows a decanter centrifuge 10 for separating heavier-phase substances, such as suspended solids, from lighter-phase substances, such as liquids. The centrifuge 10 includes a bowl 12 having a generally cylindrical clarifier section 14 adjacent to a tapered beach section 16, at least one lighter-phase discharge port 18 communicating with the clarifying section 14, and at least one heavier-phase discharge port 20 communicating with the tapered beach section 16. A screw-type conveyor 22 is rotatably mounted substantially concentrically within the bowl 12, and includes at least one helical blade 24 having a plurality of turns disposed about a conveyor hub 26, and a feed distributor and accelerator secured therein, such as a hub accelerator 28 having a distributor surface 120. The bowl 12 and conveyor 22 rotate at high speeds via a driving mechanism (not shown) but at different angular velocities about an axis of rotation 30.

A feed slurry 32 having, for example, solids 50 suspended in liquid 52, is introduced into the centrifuge 10 through a feed pipe 34 mounted within the conveyor hub 26 by a mounting apparatus (not shown). A feed pipe baffle 36 is secured to the inside surface 42 of the conveyor hub 26 to prevent the feed slurry 32 from flowing back along the inside surface 42 of the conveyor hub 26 and the outside surface of the feed pipe 34. In addition, another baffle 36 may be secured to the feed pipe 34. The feed slurry 32 exits the feed pipe 34 through a discharge opening 38, engages the distributor surface 120 of the hub accelerator 28, and forms a slurry pool 40 on the inside surface 42 of the conveyor hub 26. Various hub accelerator 28 designs are known in the industry having as an objective to accelerate the feed slurry 32 in the slurry pool 40 to the rotational speed of the conveyor hub 26.

The feed slurry 32 exits the conveyor hub 26 through at least one passageway 44 formed in the conveyor hub 26, and enters the zone A—A formed between the conveyor hub 26 and the bowl 12. The feed slurry 32 then forms a separation pool 46 having a pool surface 46A, within the zone A—A. As shown schematically in FIG. 1, the depth of the separation pool 46 is determined by the radial position of one or more dams 48 proximate to the liquid discharge port 18.

The centrifugal force acting within the separation pool 46 causes the heavier-phase suspended solids (or liquids) 50 in the separation pool 46 to sediment on the inner surface 54 of the bowl 12. The sedimented cake solids 50 are conveyed "up" the tapered beach section 16 by the differential rotational speed of the helical blade 24 of the conveyor 22 with respect to that of the bowl 12, then pass over a spillover lip 56 proximate to the solids discharge port 20, and finally exit the centrifuge 10 via the solids discharge port 20. The liquid 52 leaves the centrifuge 10 through the liquid discharge port 18 after flowing over the dam(s) 48. Persons skilled in the centrifuge art will appreciate that the separation of heavier-phase substances from lighter-phase substances can be accomplished by other similar devices.

Feed distributors and accelerators, such as the hub accelerator 28 in FIG. 1, do not accelerate the feed slurry to the rotational speed of the conveyor hub 26 because the feed slurry 32 contacts the inside surface 42 of the conveyor hub 26 only over a short distance before exiting the conveyor hub 26 through the passageway 44. Even if the feed slurry 32 is accelerated up to the linear circumferential speed of the conveyor hub 26, the speed of the feed slurry 32 as it exits the passageway 44 is less than that of the separation pool surface 46A located at a larger radius from the axis of rotation 30. Therefore, feed slurry acceleration enhancements are required.

Figure 2A:
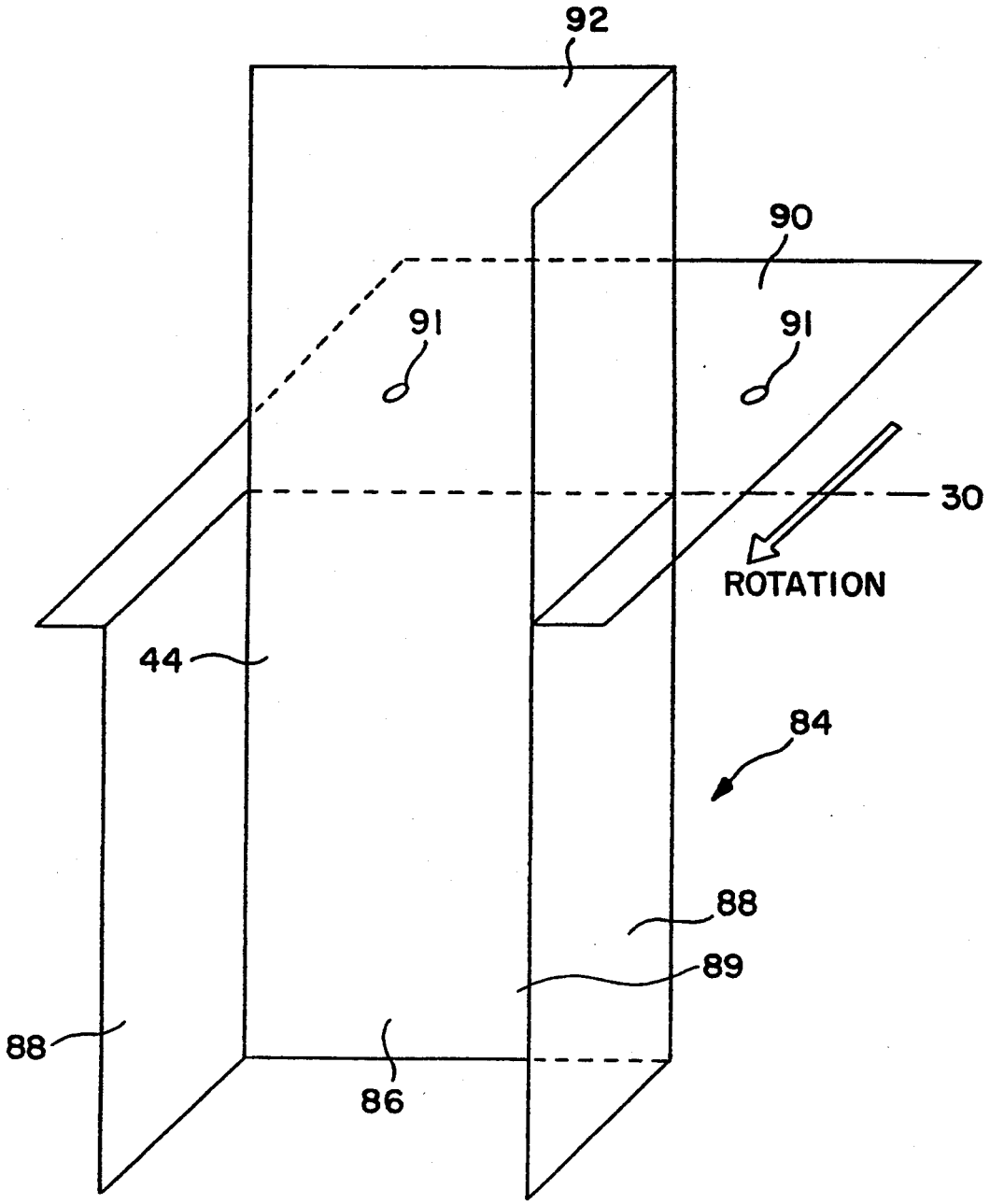
FIG. 2A is a perspective view of a U-shaped channel.
Figure 2B:
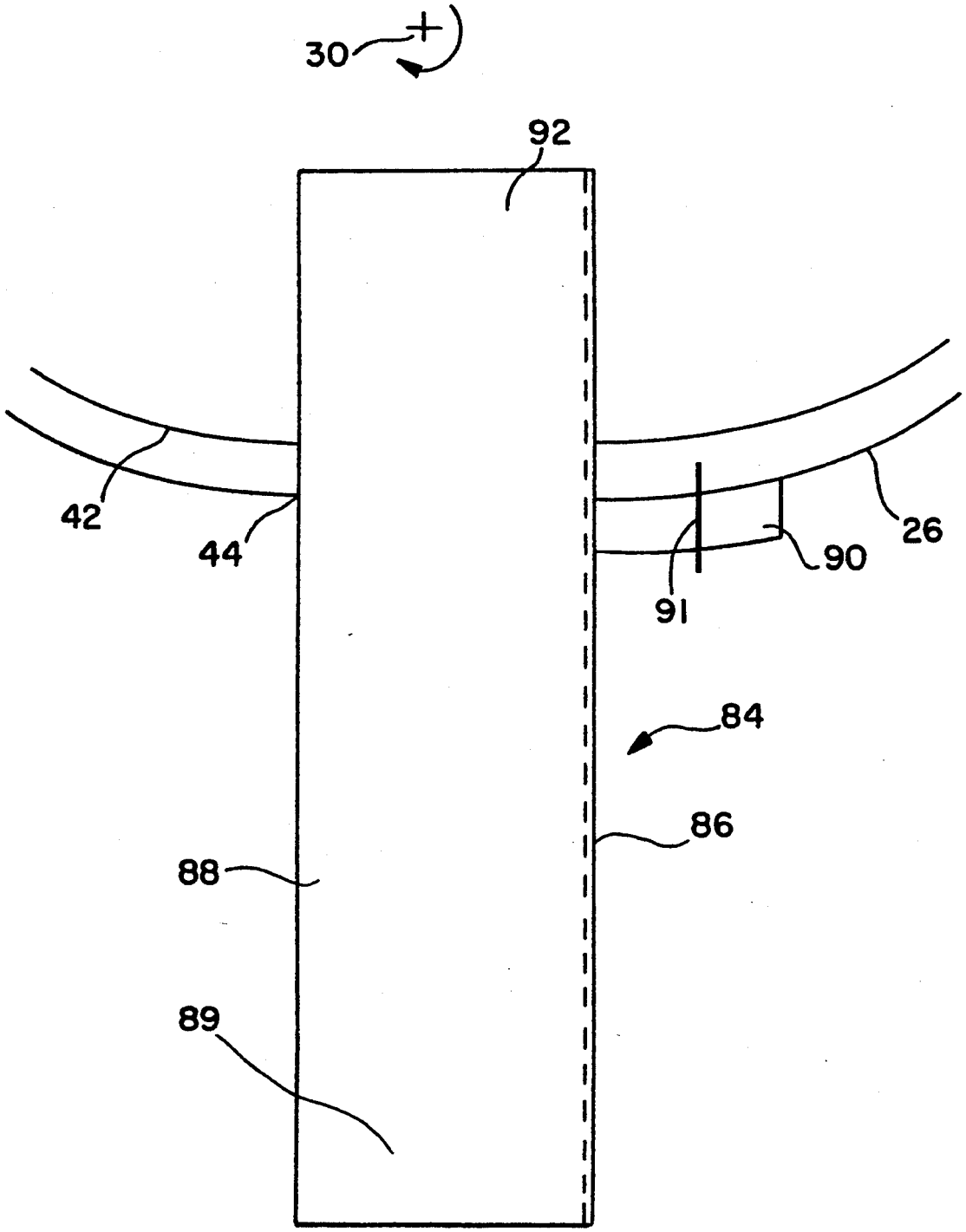
FIG. 2B is a side view of the U-shaped channel of FIG. 2A.

FIG. 2A shows a feed slurry acceleration enhancement including a generally U-shaped channel 84, extending outwardly from the passageway 44 and secured thereto by a hub tab 90 and screws 91. FIG. 2B shows a side view of the U-shaped channel 84 communicating with the passageway 44. The generally U-shaped channel 84 includes an outwardly extending base 86 generally parallel to the axis of rotation 30, and two outwardly extending side walls 88 adjacent to the base 86 and generally perpendicular to the axis rotation 30 of the conveyor hub 26. In this particular embodiment, the U-shaped channel 84 communicates with an inwardly extending L-shaped baffle 92 which opposes the Coriolis force (which acts on the feed slurry 32 to impede the flow of the feed slurry 32 exiting the passageway 44) and directs the feed slurry 32 into the passageway 44. The U-shaped channel 84 acts as an exterior accelerating baffle of the conveyor hub 26 and is particularly useful for feed slurries that may contain large masses of solids because the open nature of the U-shaped channel 84 reduces the possibility of self-clogging and of clogging passageway 44. It is understood that the U-shaped channel 84 may be used without the L-shaped baffle 92.

Additional modifications may be made to the U-shaped channel 84 to increase the linear circumferential speed of the feed slurry 32 exiting the conveyor hub 26. For example, the side walls 88 may not extend the entire length of the base 86, may taper from a wide width to a narrow width or visa versa, or may have a constant narrow width in relation to the width of the base 86. There is also the possibility that the side walls 88 and the base 86 may join in a curved manner so as to form a U-shaped channel 84 having no sharp bends or junctions. The side walls 88 may be parallel to one another and perpendicular to the base 86, as shown in FIG. 2A. Alternatively, the side walls 88 may not be parallel to one another and not perpendicular to the base 86 so as to form a U-shaped channel 84 having a larger or smaller exit opening than the size of the passageway 44.

Figure 3A:
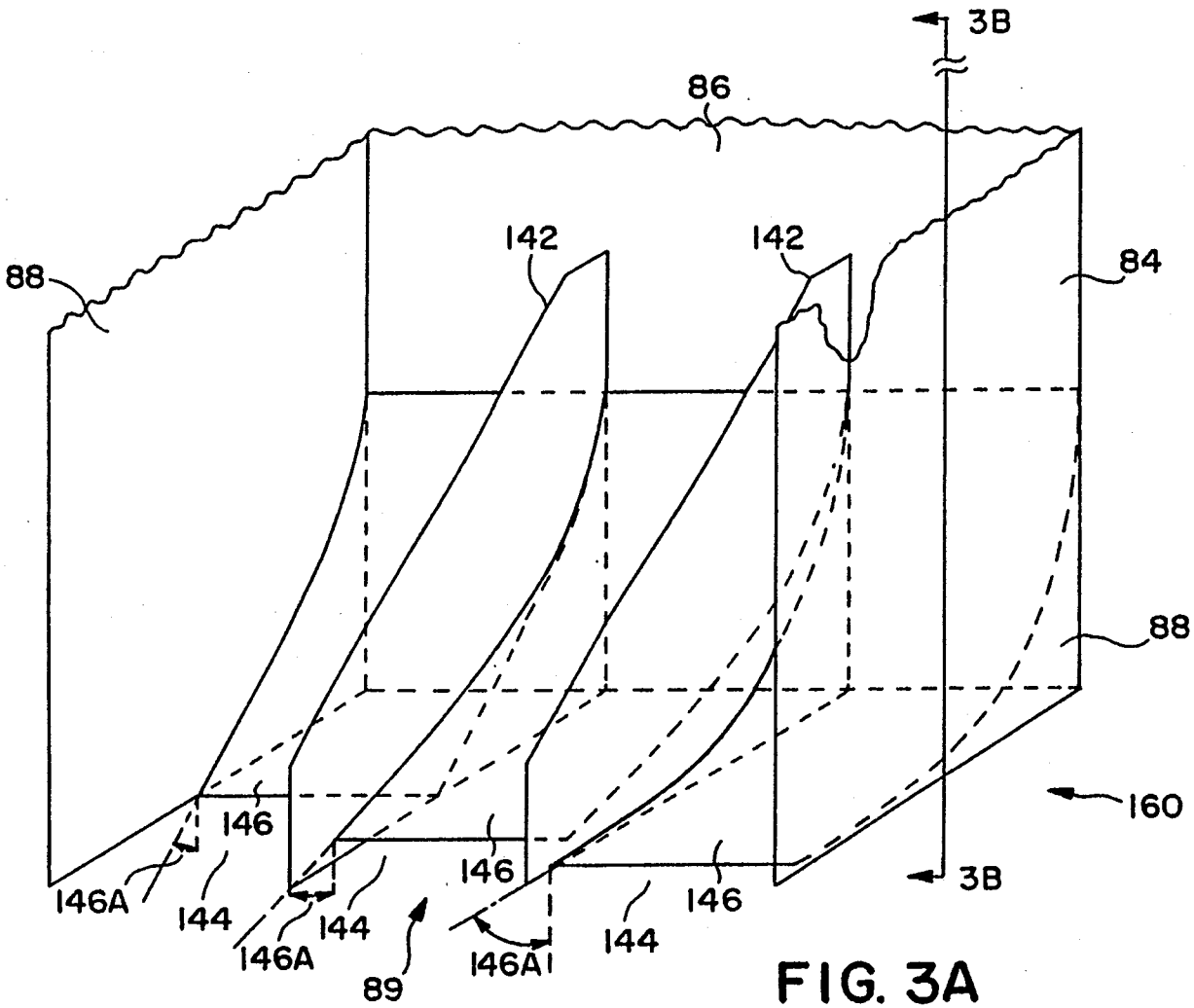
FIG. 3A is a perspective view of the discharge end of a U-shaped channel including partitions and flow directing and overspeeding vanes.

An experimental rig was used to study the effectiveness of the U-shaped channel 84 of FIG. 2A, in combination with a flow directing and overspeeding vane similar to the vane 146 in FIG. 3A (as more fully described below) attached to the discharge end 89 of the U-shaped channel 84. The conveyor hub 26 of the experimental rig included inner and outer diameters of 8:125 inches and 9.80 inches, respectively. The inside diameter of the feed pipe was 2.3 inches. The distance from the distributor surface 120 of the hub accelerator 28 to the feed pipe discharge opening 38 was 7.7 inches and the distance from the distributor surface 120 to the baffle 36 was 10.75 inches. Four passageways 44 were positioned 90 degrees apart in the wall of conveyor hub 26, each passageway 44 having a rectangular cross-section, with the dimensions of 3 inches parallel to the axis of rotation 30 and 2 inches circumferentially. Within each of the four passageways 44 was affixed a U-shaped channel 84 having a base 86 with an inside dimension of 2.625 inches and two side walls 88 each having an inside dimension of 1.625 inches. Each U-shaped channel 84 communicated with an L-shaped baffle 92 which extended into the conveyor hub 26 a distance of 1.75 inches from inside surface 42 of conveyor hub 26.

Each U-shaped channel 84 with affixed flow directing and overspeeding vane 146 extended outwardly from a passageway 44 to a radius of approximately 10.5 inches, measured from the axis of rotation 30. The acceleration efficiency was determined for various forward discharge angles 146A (measured from the radial direction), as shown in FIG. 3A, of vane 146. At a conveyor hub 26 rotational speed of approximately 2000 revolutions per minute, and with a flow rate of feed slurry 32 (modeled by water), of 400 gallons per minute, values of acceleration efficiency were determined to be as follows:

| Forward Discharge | 0 | 30 | 45 | 60 | 75 | 90 |
|---|---|---|---|---|---|---|

-continued

| Angle (deg.) | | | | | | |
|---|---|---|---|---|---|---|
| Acceleration Efficiency, percent | 105 | 142 | 147 | 156 | 157 | 154 |

The results show that over a wide range of forward discharge angles 146A of vane 146, from about 30 degrees to 90 degrees, acceleration efficiencies of about 150 percent can be achieved, with maximum acceleration efficiency occurring when the forward discharge angle 146A of the flow directing and overspeeding vane 146 is in the range of 60 degrees to 75 degrees. The test results also show that over a wide range of forward discharge angles 146A, for example 30 degrees to 90 degrees, the acceleration efficiency varies only weakly with the forward discharge angle 146A. It is noted that acceleration efficiency is here calculated at the value corresponding to the outermost radius of vane 146. Therefore, these results show that the pool surface 46A may be at a radius greater than the outermost radius of vane 146 by a factor of as much as 1.22, without causing the effective acceleration efficiency at pool surface 46A to fall below 100 percent.

Although high acceleration efficiencies may be obtained with U-shaped channels or other extension tubes having a flow directing and overspeeding vane, such configurations have disadvantages in that the feed slurry 32 is discharged into the separation pool 46 in the form of concentrated streams or jets which result in a remixing of the separated solids 50 and the separated liquids 52 in the separation pool 46, and a consequent decrease in separation efficiency.

Figure 3B:
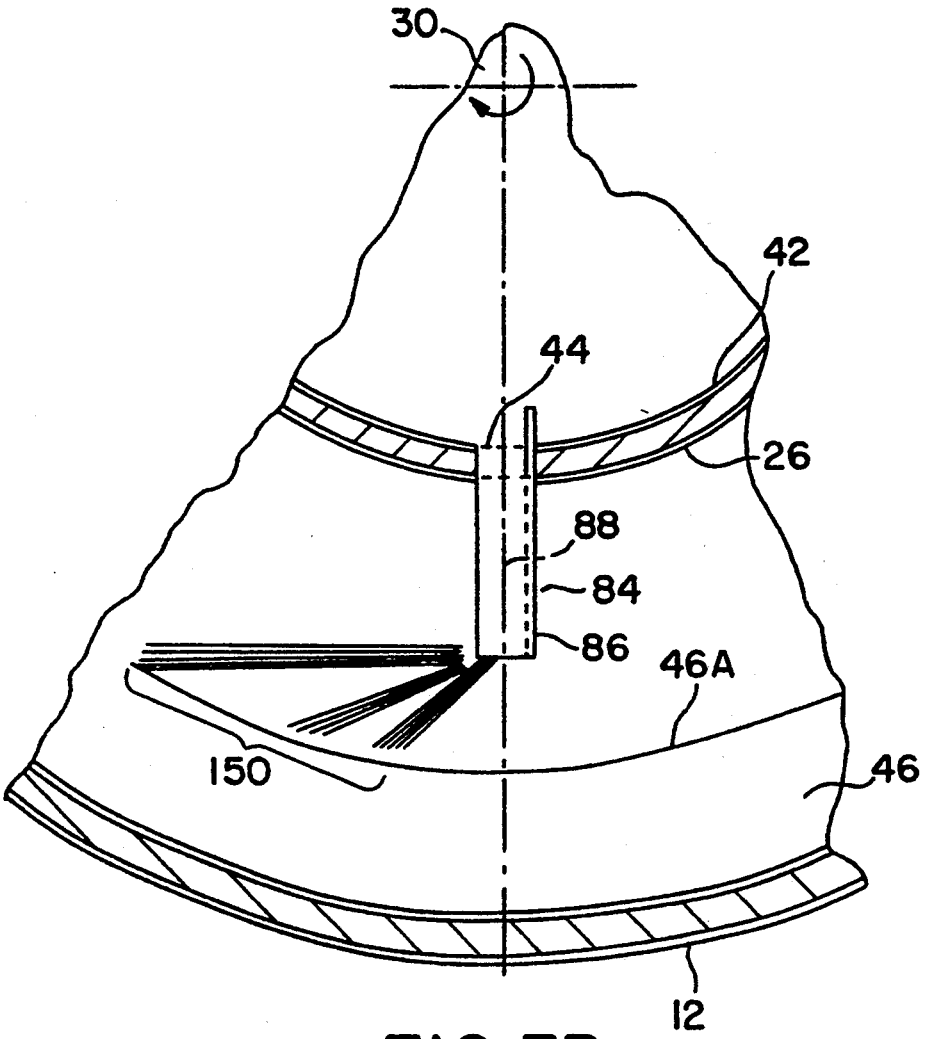
FIG. 3B is a partial cross-sectional view along line 3B—3B of FIG. 3A of a decanter centrifuge including the U-shaped channel of FIGS. 2A and 2B having the discharge end of FIG. 3A.

As more fully described below, his remixing problem can be substantially reduced by exploiting the aforementioned insensitivity of the acceleration efficiency to the forward discharge angle 146A of the flow directing and overspeeding vane 146. As shown in FIG. 3A, the U-shaped channel 84 is modified so that its outer end 89 is divided by a plurality of partitions 142 parallel to the side walls 88 into a plurality of discharge channels 144. As shown in FIG. 3A, the discharge channels 144 may be of equal widths. Alternatively, the discharge channels 144 may be of variable widths. Each channel 144 includes a forward-curved flow directing and overspeeding vane 146 having a different forward discharge angle 146A for each such discharge channel 144. The vanes 146 in combination with partitions 142 form an overspeeding apparatus 160. FIG. 3B shows that the feed slurry 32 exits the U-shaped channel 84 from the outlets of the several discharge channels 144 at different angles, such as between 30 degrees and 90 degrees (measured from the radial direction), with respect to the radial direction. Accordingly, the entry position of the feed slurry 32 into the separation pool 46 is spread out circumferentially over an arc 150, thus providing greater circumferential uniformity with an attendant reduction of remixing caused by impingement of the feed slurry 32 on the pool surface 46A of the separation pool 46.

To reduce the cost of centrifuge maintenance, the vanes 146 and partitions 142 may be removable and may include a wear resistant material.

A greater circumferential spray or arc 150 (as much as 180 degrees) and a more uniformly distributed spray of the feed slurry 32 can be obtained with the multispray nozzle of the invention. In the preferred embodiment, as shown in FIG. 4, the multispray nozzle 83 includes a plurality of outwardly extending extensions 83A associated with the passageway 44, each extension 83A including the discharge end 89 of FIG. 3A and an axis X—X.

Figure 4:
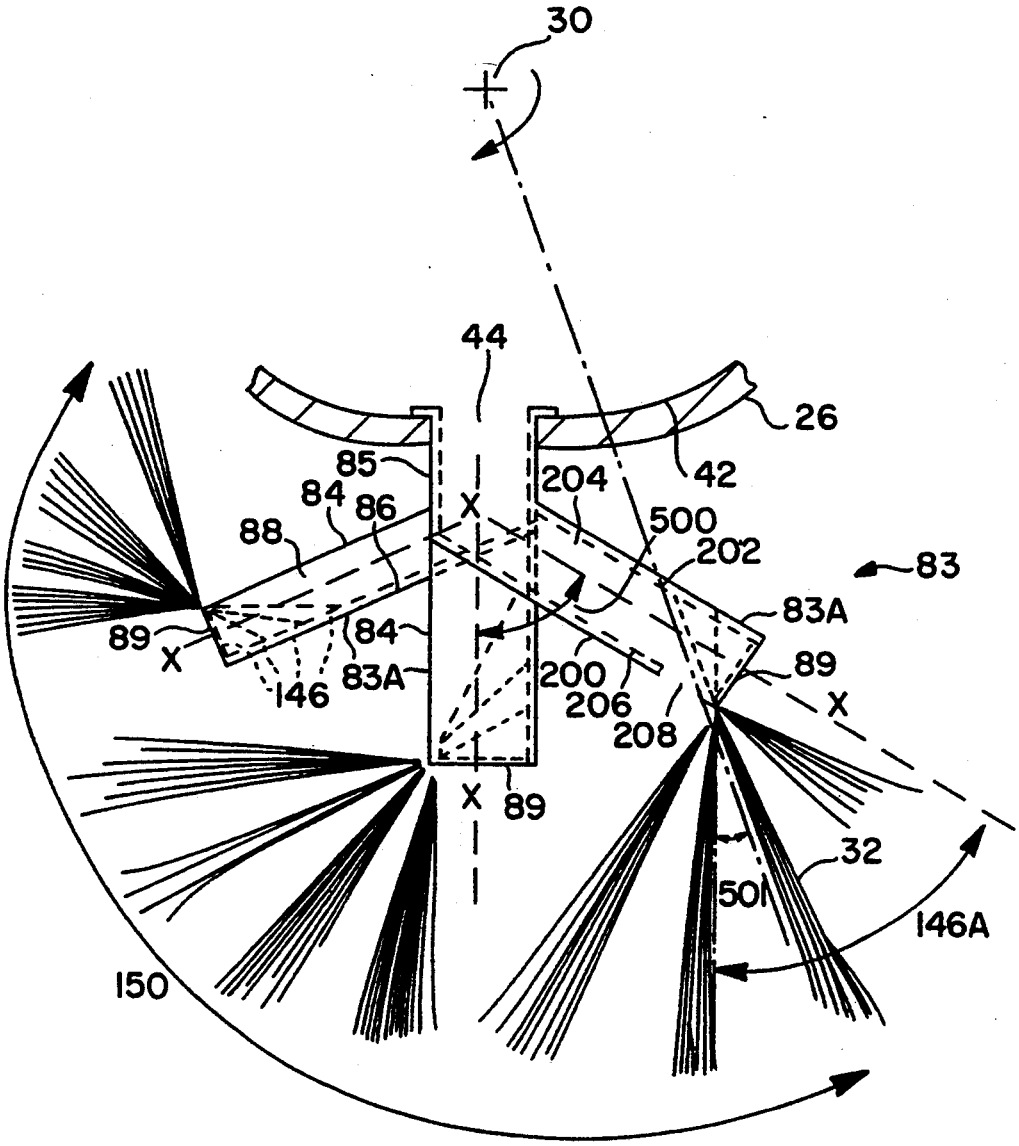
FIG. 4 is a cross-sectional view of the conveyor hub of a decanter centrifuge including the multispray nozzle of the invention.

Each extension 83A having its axis X—X oriented parallel to and at forward angles to the radial direction of the conveyor hub 26 at the passageway 44, as shown in the clockwise direction in FIG. 4, is a generally U-shaped channel 84 including a base 86 disposed between two side walls 88. Each extension 83A having its axis X—X oriented at reverse angles to the radial direction of the conveyor hub 26 at the passageway 44, as shown in the counter clockwise direction in FIG. 4, is a generally full channel 200 including a base 202 and a front section 206 disposed between two side walls 204. The base 202 extends a greater radial distance than the front section 206 so that an opening 208 is formed in at the discharge end 89 of the full channel 200. It is understood that an extension 83A having its axis X—X oriented at a small reverse angle or having a short length may also be a U-shaped channel.

The front section 206 is required for all extensions 83A oriented at relatively large reverse angles to the radial direction of the conveyor hub 26 at the passageway 44 so as to direct the feed slurry 32 exiting the passageway 44 and entering such extension 83A into the discharge channels 144 formed at the discharge end 89 by the partitions 142 and the overspeeding vanes 146. As shown in FIG. 4, the extension 83A may communicate with and extend from a central extension 85, for example, as shown as having its axis X—X oriented in the radial direction of the conveyor hub 26. The resulting spray arc 150 may be oriented parallel to the turns of the helical blade 24 or, as shown in FIG. 4, perpendicular to the axis of rotation 30. It is understood that each extension 83A may also communicate with and extend from the passageway 44.

The multispray nozzle 83 shown in FIG. 4 causes the feed slurry 32 to enter into the separation pool 46 over a much large arc 150 than the arc 150 shown in FIG. 3B, thus providing a much greater circumferential uniformity of feed slurry flow into the separation pool 46 while substantially reducing the remixing problem. As shown in FIG. 4, approximately a 180 degree feed slurry spray or arc 150 may be achieved with the multispray nozzle of FIG. 4. If four passageways 44 are formed and spaced circumferentially 90-degree apart in the conveyor hub 26 and a multispray nozzle 83 of FIG. 4 is associated with each passageway 44, the resulting feed spray or arc 150 will cause a 90 degree overlap of the sprayed feed slurry 32 from two adjacent extensions 83A of the hub 26, thus resulting in a greater circumferential feed slurry 32 distribution than normally achieved with only one extension 83A or a conventional nozzle without any liquid accelerating and distributing enhancements.

The number of extensions 83A, angle 500 of the axis of each extension, angle of flow directing and overspeeding vanes 146, width and number of the discharge channels 144, and discharge radius of the outer end 89 of each extension 83A, are selected so as to achieve the desired circumferential flow uniformity, circumferential velocity and spray arc 150.

As shown in FIG. 4, it is desirable to have a resultant angle 501 for all of the discharge channels 144 of the multispray nozzle 83 in a forward direction with respect the radial direction of the conveyor hub 26 at the passageway 44 so as to achieve overspeeding on the liquid exiting all discharge channels 144. The resultant angle 501 depends on the angle 500 of the axis X—X of each extension 83A, the angle of the overspeeding vane 146A, and the radial location and the length of the extension 83A.

Figure 5:
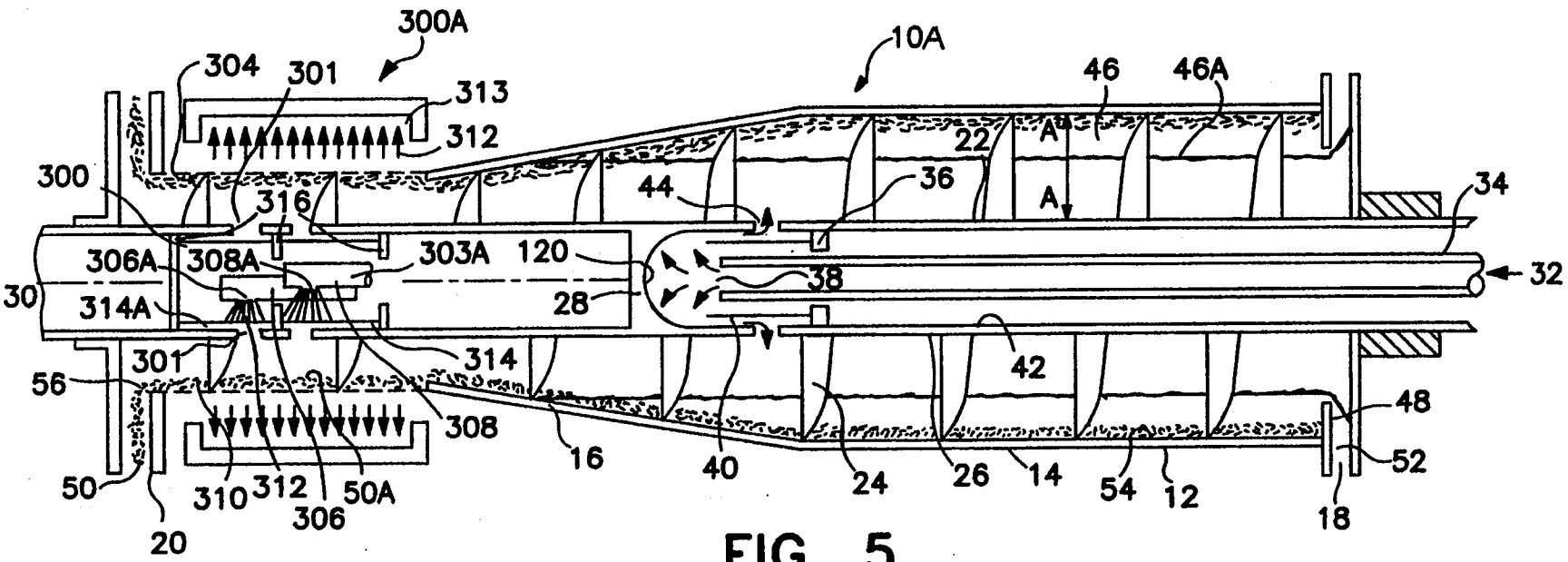
FIG. 5 is a schematic cross-sectional view of a screenbowl centrifuge.

It is also understood that the multispray nozzle of the invention may be used in a centrifuge to spray the cake solids during the washing operation to remove any impurities or to recover a mother liquor within the cake solids. More specifically, FIG. 5 shows a screenbowl centrifuge 10A similar to the decanter centrifuge 10 of FIG. 1. The screenbowl centrifuge 10A includes a wash feed compartment section 300A disposed between the solids discharge port 20 and the tapered beach section 16. A wash liquid 312 is introduced into the wash feed compartment 300 by at least one wash pipe. As shown in FIG. 5, the screenbowl centrifuge 10A includes a wash pipe 306 having an opening 306A and a wash pipe 308 having an opening 308A. Baffles 316 are secured to the inside surface 42 of the conveyor hub 26 to prevent the mixing of the wash liquid 312 introduced into the wash feed compartment 300 by each pipe 306 and 308. The wash liquid 312 forms a liquid pool 314 on the inside surface of the wash feed compartment 300, which is integral with the conveyor hub 26, after exiting the openings 306A and 308A and then exits the passageways 301 to wash the cake 50 being conveyed by the helical blade 24 of the conveyor 22 along a rotating screen section 304 of the wash compartment section 300A. The wash liquid 312 is then collected in a liquid collection chamber 313 after exiting the screen section 304.

Improved washing of the cake solids 50 is achieved when the wash liquid 312 is accelerated approximately to the circumferential velocity of the cake solids 50 and when the wash liquid 312 is spread out uniformly over a larger area of the cake surface 50A. Such acceleration and spreading of the wash liquid 312 is accomplished by incorporating the multispray nozzle 83 of the invention into the passageway 301 of the conveyor hub 26. More specifically, FIG. 6A shows a plurality of extensions 83A extending from a central extension 85 communicating width the passageway 301. The central extension 85 includes a baffle 320 which extends into the wash liquid pool 314 to counterpose the Coriolis force which acts on the wash liquid 312 to impede the wash liquid 312 from exiting the passageway 301. It is understood that the multispray nozzle 83 may be used without a baffle 320.

At least one extension 83A having an axis X—X oriented at a forward angle to the radial direction of the conveyor hub 26 at the passageway 301, shown as clockwise in FIG. 6A, is a generally U-shaped channel as previously described. At least one extension 83A having an axis X—X oriented at a reverse angle to the radial direction of the conveyor hub 26 at the passageway 301, shown as counter clockwise in FIG. 6A, is a generally full channel as previously described. It is understood that an extension 83A having its axis X—X oriented at a small reverse angle or having a short length may also be a U-shaped channel. Each U-shaped or full channel includes the discharge end 89 of FIG. 3A. FIG. 6B shows that each partition 142 is angled proximately in the direction of the axis of rotation 30 of the centrifuge and is tapered at its end so that the wash liquid 312 exiting the discharge end 89 is spread out not only approximately circumferentially but also approximately axially over a larger area of the cake solids surface 50A.

It is understood that the multispray nozzle of the invention may also be used in screenbowl centrifuges of other designs different from the one shown in FIG. 5, such as a conical screenbowl centrifuge having no cylindrical section. The multispray nozzle 83 of the invention may also be used in pusher-type or general basket-type centrifuges.

What is claimed is:

1. A liquid accelerator system for use in a centrifuge, the system comprising a conveyor hub rotatably mounted substantially concentrically within a rotating bowl, the hub including an inside surface and an outside surface, at least one passageway between the inside surface of the conveyor hub and the outside surface of the conveyor hub, and a plurality of outwardly extending extensions attached to each passageway wherein the extensions extend in a generally radial direction.

2. A liquid accelerator system for use in a centrifuge, the system comprising a conveyor hub rotatably mounted substantially concentrically within a rotating bowl, the hub including an inside surface and an outside surface, at least one passageway between the inside surface of the conveyor hub and the outside surface of the conveyor hub, and a plurality of outwardly extending extensions attached to each passageway, each extension having a discharge end wherein a plurality of partitions extend in a circumferential direction from the discharge end of each extension so as to form a plurality of discharge channels, a flow directing and overspeeding vane is disposed within each discharge channel and extends radially and circumferentially from the discharge end, each flow directing and overspeeding vane having a different forward discharge angle, the flow directing and overspeeding vanes are angled in the direction of rotation of the conveyor hub, and the number of extensions, angle of the axis of each extension, angle of flow directing and overspeeding vanes, width and number of the discharge channels, and discharge radius of each discharge channel are selected so as to achieve a desired circumferential flow uniformity, circumferential velocity and spray arc.

3. A liquid accelerator system for use in a centrifuge, the system comprising a conveyor hub rotatably mounted substantially concentrically within a rotating bowl, the hub including an inside surface and an outside surface, at least one passageway between the inside surface of the conveyor hub and the outside surface of the conveyor hub, and a plurality of outwardly extending extensions attached to each passageway wherein the extensions extend in a generally radial and circumferential direction.

4. The liquid accelerator system of claim 1 wherein a central extension is attached to the passageway and at least one extension is attached to and extends from the central extension.

5. The liquid accelerator system of claim 1 wherein at least one extension having an axis oriented parallel to the radial direction of the conveyor hub at the passageway is a generally U-shaped channel including a discharge end.

6. The liquid accelerator system of claim 1 wherein at least one extension having an axis oriented at a forward angle to the radial direction of the conveyor hub at the passageway is a generally U-shaped channel including a discharge end.

7. The liquid accelerator system of claim 1 wherein at least one extension having an axis oriented at a reverse angle to the radial direction of the conveyor hub at the passageway is a fully enclosed channel including a discharge end.

8. The liquid accelerator system of claim 1 wherein at least one extension having an axis oriented at a reverse angle to the radial direction of the conveyor hub at the passageway is a generally U-shaped channel including a discharge end.

9. The liquid accelerator system of claim 1 or 2 further including a feed slurry liquid to be accelerated.

10. The liquid accelerator system of claim 1 or 2 further including a wash liquid to be accelerated.

11. The liquid accelerator system of claim 1 or 2 wherein the passageway further includes a baffle extending radially inward into a slurry pool formed on the inside surface of the conveyor hub.

12. The liquid accelerator system of claim 1 wherein the conveyor hub has at least one turn of a helical blade mounted on the outside surface and the extensions are generally aligned in a plane substantially parallel to the turn of the helical blade.

13. The liquid accelerator system of claim 1 wherein the extensions are generally aligned in a plane substantially perpendicular to the axis of the conveyor hub.

14. The liquid accelerator system of claim 5, 6, 7 or 8 wherein a plurality of partitions extend in a circumferential direction from the discharge end so as to form a plurality of discharge channels, and a flow directing and overspeeding vane is disposed within each discharge channel and extends radially and circumferentially from the discharge end, each flow directing and overspeeding vane having a different forward discharge angle.

15. The liquid accelerator system of claim 5, 6, 7 or 8 wherein the flow directing and overspeeding vanes are angled in the direction of rotation of the conveyor hub.

16. The liquid accelerator system of claim 5, 6, 7 or 8 wherein the passageway includes a cross-sectional area having a longer axis approximately parallel to the axis of rotation of the conveyor hub.

17. The liquid accelerator system of claim 5, 6, or 8 wherein the U-shaped channel includes an approximate oval cross section.

18. The liquid accelerator system of claim 5, 6 or 8 wherein the U-shaped channel includes an approximate circular cross section.

19. The liquid accelerator system of claim 5, 6 or 8 wherein the U-shaped channel includes an outwardly extending base disposed between two outwardly extending side walls.

20. The liquid accelerator system of claim 7 wherein the full channel includes an approximate oval cross section.

21. The liquid accelerator system of claim 7 wherein the full channel includes an approximate circular cross section.

22. The liquid accelerator system of claim 7 wherein the fully enclosed channel includes an outwardly extending base and an outwardly extending front section disposed between two outwardly extending side walls, wherein the base extends from the passageway to a greater radial distance than the front section.

23. The liquid accelerator system of claim 14 wherein at least one partition includes a tapered outside edge.

24. The liquid accelerator system of claim 14 wherein the discharge channels have a constant width which is varied between discharge channels.

25. The liquid accelerator system of claim 14 wherein the discharge channels have a width which varies along the radius of the discharge channels.

26. The liquid accelerator system of claim 4 wherein the central extension includes a baffle extending into the conveyor hub.

* * * * *

UNITED STATES PATENT AND TRADEMARK OFFICE

CERTIFICATE OF CORRECTION

PATENT NO. : 5,403,486

DATED : April 4, 1995

INVENTOR(S) : Woon F. Leung

It is certified that error appears in the above-indentified patent and that said Letters Patent is hereby corrected as shown below:

Column 7, line 33: please delete "his" and insert therefor -- this --;

Column 10, line 22: please delete existing claim 2 and insert therefor the appropriately amended version of claim 2, as follows:

2. A liquid accelerator system for use in a centrifuge to separate a slurry fee, the system comprising a conveyor hub rotatably mounted substantially concentrically within a rotating bowl, the hub including an inside surface and an outside surface, the rotating bowl including an inside surface, a separation pool of feed slurry located on the insider surface of the rotating bowl, the separation pool including a pool surface, at least one passageway between the inside surface of the conveyor hub and the outside surface of the conveyor hub, and a plurality of outwardly extending extensions associated with each passageway, each extension having a discharge end wherein a plurality of partitions extend in a circumferential direction from the discharge end of each extension so as to form a plurality of discharge channels, a flow directing and overspeeding vane is disposed within each discharge channel and extends radially and circumferentially from the discharge end, each flow directing and overspeeding vane having a different forward discharge angle,

UNITED STATES PATENT AND TRADEMARK OFFICE

CERTIFICATE OF CORRECTION

PATENT NO. : 5,403,486

DATED : April 4, 1995

INVENTOR(S) : Woon F. Leung

It is certified that error appears in the above-indentified patent and that said Letters Patent is hereby corrected as shown below:

the flow directing and overspeeding vanes are angled in the direction of rotation of the conveyor hub, and the number of extensions, angle of the axis of each extension, forward angle of flow directing and overspeeding vanes, width and number of the discharge channels, number of flow directing and overspeeding vanes, and discharge radius of each discharge channel are selected so as to achieve a uniform distribution of the feed slurry along the separation pool surface having the same circumferential velocity as the pool surface.

Signed and Sealed this

Fifth Day of December, 1995

*Attest:*

Bruce Lehman

BRUCE LEHMAN

*Attesting Officer*

*Commissioner of Patents and Trademarks*